United States Patent [19]

Plaia et al.

[11] 4,146,946

[45] Apr. 3, 1979

[54] APPARATUS FOR STEAMING OF TUBULAR KNITTED FABRIC

[75] Inventors: Lawrence Plaia, Brooklyn; Steven Grzybowski, Plainview, both of N.Y.

[73] Assignee: Samcoe Holding Corporation, Woodside, N.Y.

[21] Appl. No.: 817,911

[22] Filed: Jul. 22, 1977

[51] Int. Cl.[2] ..... D06C 5/00; D06C 27/00

[52] U.S. Cl. ..... 26/18.5; 26/81; 26/84; 26/DIG. 1

[58] Field of Search ..... 26/80, 81, 84, 18.5, 26/DIG. 1

[56] References Cited

U.S. PATENT DOCUMENTS

| | | | |
|---|---|---|---|
| 966,280 | 8/1910 | Weis | 26/80 X |
| 2,189,166 | 2/1940 | Cohn et al. | 26/81 X |
| 2,588,624 | 3/1952 | Evans | 26/18.5 |
| 2,944,317 | 7/1960 | Cohn et al. | 26/18.5 |
| 3,007,223 | 11/1961 | Wehrmann | 26/81 X |
| 3,044,142 | 7/1962 | Brunner | 26/18.5 |
| 3,098,279 | 7/1963 | Brunner | 26/18.5 |
| 3,585,696 | 6/1971 | Aronoff | 26/18.5 |
| 3,701,315 | 10/1972 | Maund | 26/80 X |
| 4,014,081 | 3/1977 | Bryan | 26/18.5 |
| 4,044,434 | 8/1977 | Bryan | 26/18.5 |

FOREIGN PATENT DOCUMENTS

| | | | |
|---|---|---|---|
| 203764 | 9/1923 | United Kingdom | 26/81 |
| 230977 | 3/1925 | United Kingdom | 26/84 |

*Primary Examiner*—Robert Mackey

*Attorney, Agent, or Firm*—Mandeville and Schweitzer

[57] ABSTRACT

An apparatus is disclosed for continuously framing and steaming discrete segments of tubular knitted fabric, particularly sweater body segments and the like which are constructed to include a body section provided with a cuff at one end. The apparatus provides for differential width stabilization of the segment, such that the body portion is set at one width and the cuff portion is set at a slightly narrower width. Individual segments are advanced over a spreader frame and distended to the desired width for the body portion. The section is discharged, cuff first, off of the spreader and enters between a pair of conveyor blankets. The blankets are held in noncontacting relation, initially, to permit the cuff to return to narrower dimensions, but the blankets then close upon the segment, so that the body portion thereof is maintained at an increased width. While the segment is thus engaged, it is steamed to stabilize its geometry. Of particular importance, unique provisions are made for effecting lengthwise stretching of the segment without uncontrolled loss of width such that, when the segment is gripped by the conveyor blankets, its geometry has been desirably adjusted both lengthwise and widthwise. The invention enables substantial duplication by automatic machinery of operations which heretofore have been carried out largely manually on a one-at-a-time basis.

17 Claims, 16 Drawing Figures

FIG.1
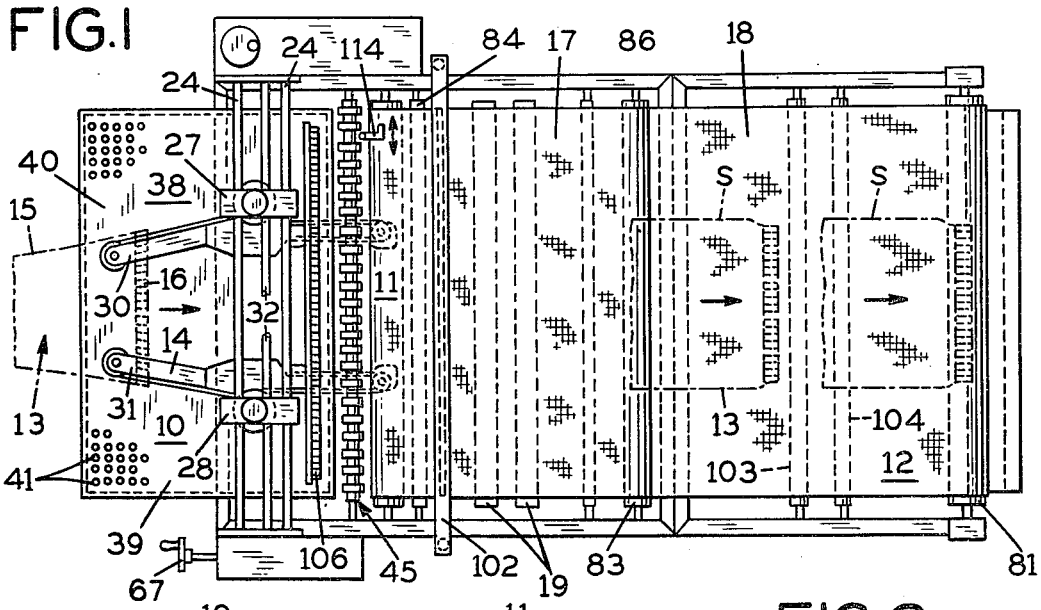
FIG.2
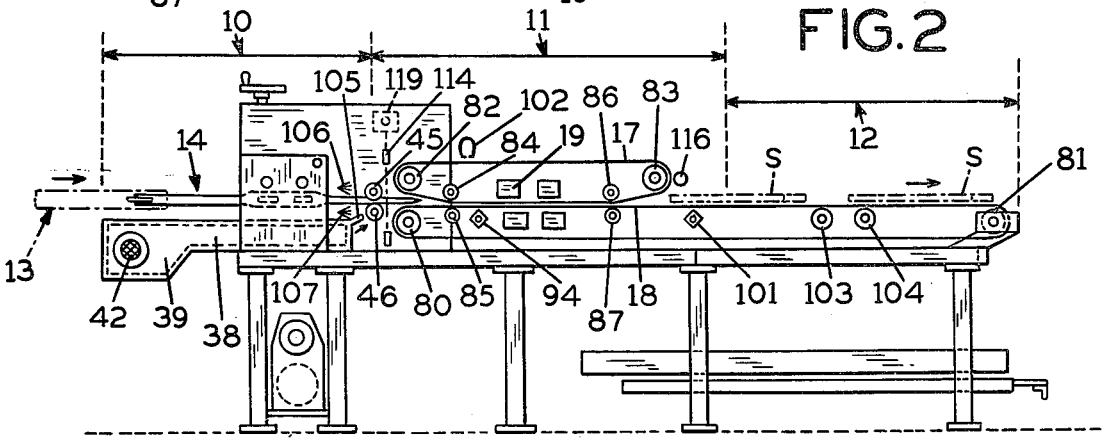
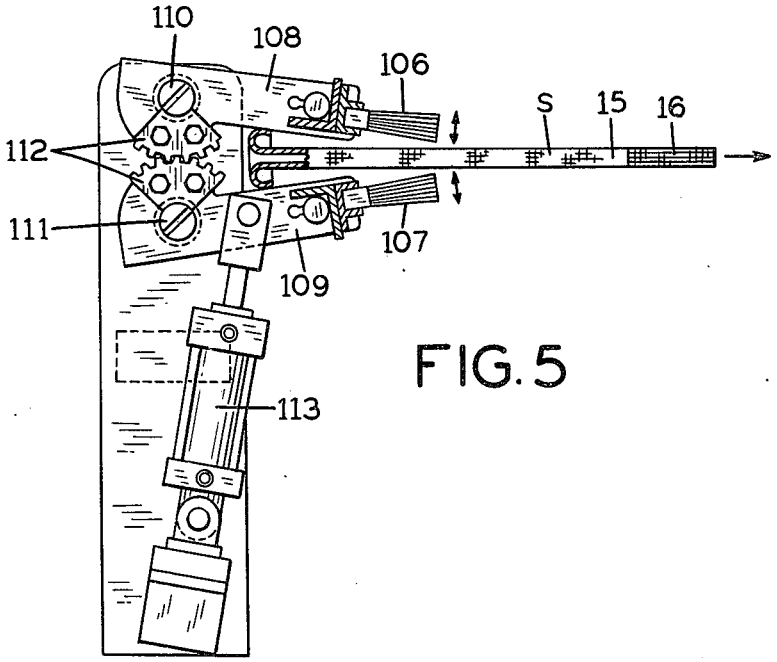
FIG.5

APPARATUS FOR STEAMING OF TUBULAR KNITTED FABRIC

RELATED CASES

This application is closely related to the Bryan U.S. Pat. No. 4,014,081, and also the Bryan U.S. application Ser. No. 594,718, filed July 10, 1975 (now U.S. Pat. No. 4,044,434), both assigned to Samcoe Holding Corporation.

BACKGROUND AND SUMMARY OF INVENTION

In the processing of segments of tubular knitted fabric, such as sweater bodies and sleeves, for example, it has been conventional in the past to perform a so-called framing and steaming operation in order to adjust and stabilize the geometry of the segment. In a typical sweater body segment, for example, a cuff portion is knitted integrally to a body portion. The knit construction of the cuff portion is different from that of the body portion, to provide a somewhat more elastic region, and the cuff portion is intended to be somewhat smaller in circumference than the body portion of the segment in order to fit more snugly to the wearer. Up until the recent past, framing and steaming has been largely a one-at-a-time operation, involving significant manual labor. Sweater bodies and other similar segments were placed manually over a frame of appropriate shape, manually positioned and steamed, and then manually removed from the frame. The above mentioned Bryan patents represent a significant advance over theretofore known procedures, in that provisions are made for framing and steaming of individual, disconnected tubular segments on a continuously operating machine, in which the segments are fed in at one end and discharged at the other. This had not been successfully accomplished theretofore, because of the problems and difficulties resulting from the fact that different portions of the same segment have different construction and, in the finished product, are intended to have different geometry.

Pursuant to the inventions of the Bryan patents, tubular sweater segments and the like are applied to the upstream end of a propeller-spreader frame and are distended to a width determined by the desired width of the body portion of the segment—a width that is excessively large with respect to the cuff portion of the segment. After passing over the spreader frame, the segment is discharged onto a conveyor blanket and, after a very short intervening space, is gripped across its upper and lower layers by opposed, synchronously moving conveyor blankets. In the short interval between discharge from the spreader frame and engagement by the opposed blankets, the body of the sweater assumes the width desired for it, and the cuff portion contracts to a desired smaller size. Thereafter, the segment is conveyed, while still gripped, through a steaming zone, which serves to substantially stabilize the geometry of the segment. After steaming, the segment is released by the upper conveyor blanket and subjected to vertical agitation so as to be repetitively lifted clear of the lower conveyor blanket and permitted to adjust and stabilize further. The finished unit is discharged from the lower conveyor blanket and is ready to be manufactured into a sweater.

The method and apparatus of the present invention, is based directly upon the inventions of the above mentioned Bryan U.S. patents, but incorporates certain improvements therein. In particular, the present invention serves to substantially extend the operational range of the Bryan inventions, to be applicable to a greater variety of knitted constructions often utilized in the manufacture of sweaters and the like. Thus, for many popular knit constructions, it is either necessary or desirable to controllably lengthen the segment, as well as to controllably and differentially distend it laterally. The method and apparatus of the present invention, having the capability of doing that, is applicable to a much larger spectrum of types and styles of knitted constructions for sweaters and the like.

In accordance with one of the more specific aspects of the invention, provision is made for having a firm gripping engagement with the tubular segment, across its width, while the segment is still on the spreader frame. As leading portions of the segment are discharged from the spreader frame, they are gripped across the full width by opposed conveyor blankets, while trailing portions remain gripped by other means. Between the two gripped areas, a predetermined differential speed relationship may be maintained, in order to impart a desired lengthwise tension to the fabric. While under such tension, however, the fabric remains on the spreader frame throughout almost the entire distance, such that the uncontrolled narrowing of the fabric as a result of the tension is avoided. In order to effect the desired across-the-width gripping of the segment while still on the spreader frame, a unique form of telescopically adjustable, banded gripping roll is provided, which enables the fabric to be effectively gripped and controlled across its width, while it remains on the spreader frame, without regard to the adjusted width of the spreader frame.

In accordance with another specific aspect of the invention, provision is made for controllably varying the timing of the gripping engagement of the segment by the opposed conveyor blankets. The arrangement is such that, after discharge of the cuff portion of the segment from the spreader frame, an adequate interval of time is provided to enable a substantial adjustment and reduction in width of the cuff portion before the cuff is gripped by the conveyor blankets. After passage of the cuff, the opposed relationship of the conveyor blanket is adjusted, so that the body portion of the segment is gripped by the blankets substantially immediately as it is discharged from the spreader frame. While providing for the desired contraction of the cuff portion, this arrangement affords a greater degree of control over the width of the body portion and, at the same time, enables desired amounts of longitudinal tension to be applied to the body portion without uncontrolled loss of width.

In accordance with another aspect of the invention, provision is made for handling and processing of the tubular knitted segment while on the spreader frame, so as to minimize any distortion of cross lines which otherwise may tend to result from lateral distension of the fabric. To this end, the propeller-spreader system advantageously includes a dual belt arrangement, with the upstream belts advancing the fabric at a slightly greater rate of speed than it is removed by the downstream belts, to provide for a so-called overfeed of the fabric at the transition area. In addition, an air table is provided directly underneath the spreader frame to help support segments of substantial width against sagging, which might otherwise result in distortions from the sag itself, and/or friction and retarding by reason of contact of the sagging fabric with other parts of the machine.

In accordance with another and still more specific aspect of the invention, an advantageous form of decurling means is provided, which permits the unrestricted passage of the leading end of the sweater segment, but which engages at least the trailing edge portion of the segment in a manner to unfold any curl which may form in the trailing edge of the fabric during prior handling.

For a more complete understanding of the above and other features and advantages of the invention, reference should be made to the following detailed description and to the accompanying drawings.

DESCRIPTION OF THE DRAWINGS

FIG. 1 is a top plan view of apparatus according to the invention for framing and steaming of tubular knitted fabric segments.

FIG. 2 is a side elevational view of the apparatus of FIG. 1.

FIG. 5 is a fragmentary cross sectional view as taken generally along line 5—5 of FIG. 4*a*, showing details of a decurler arrangement.

DESCRIPTION OF A PREFERRED EMBODIMENT

Figure 3A:
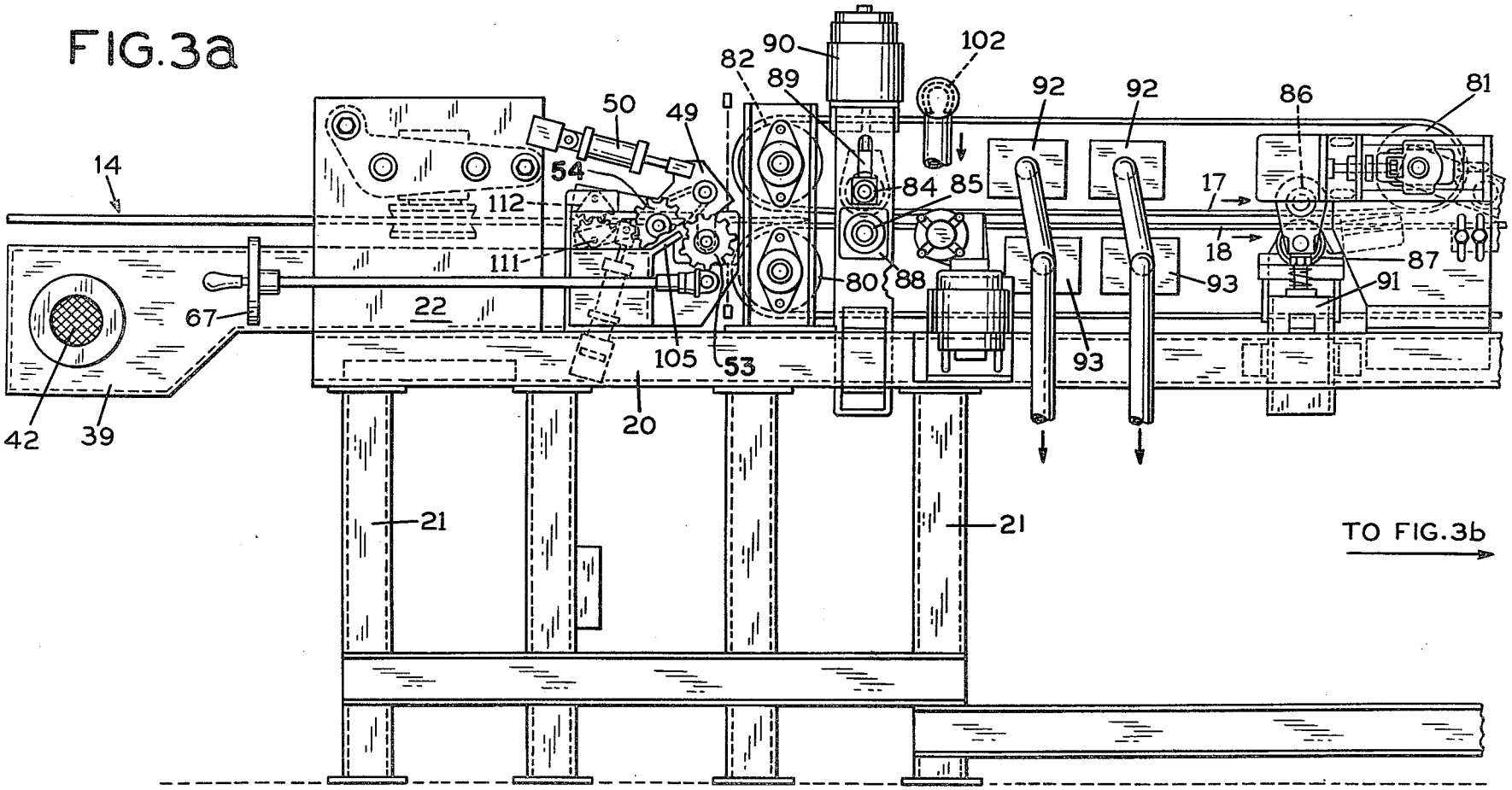
FIGS. 3*a* and 3*b*, taken together, form an enlarged side elevational view of the apparatus of FIG. 1.
Figure 3B:
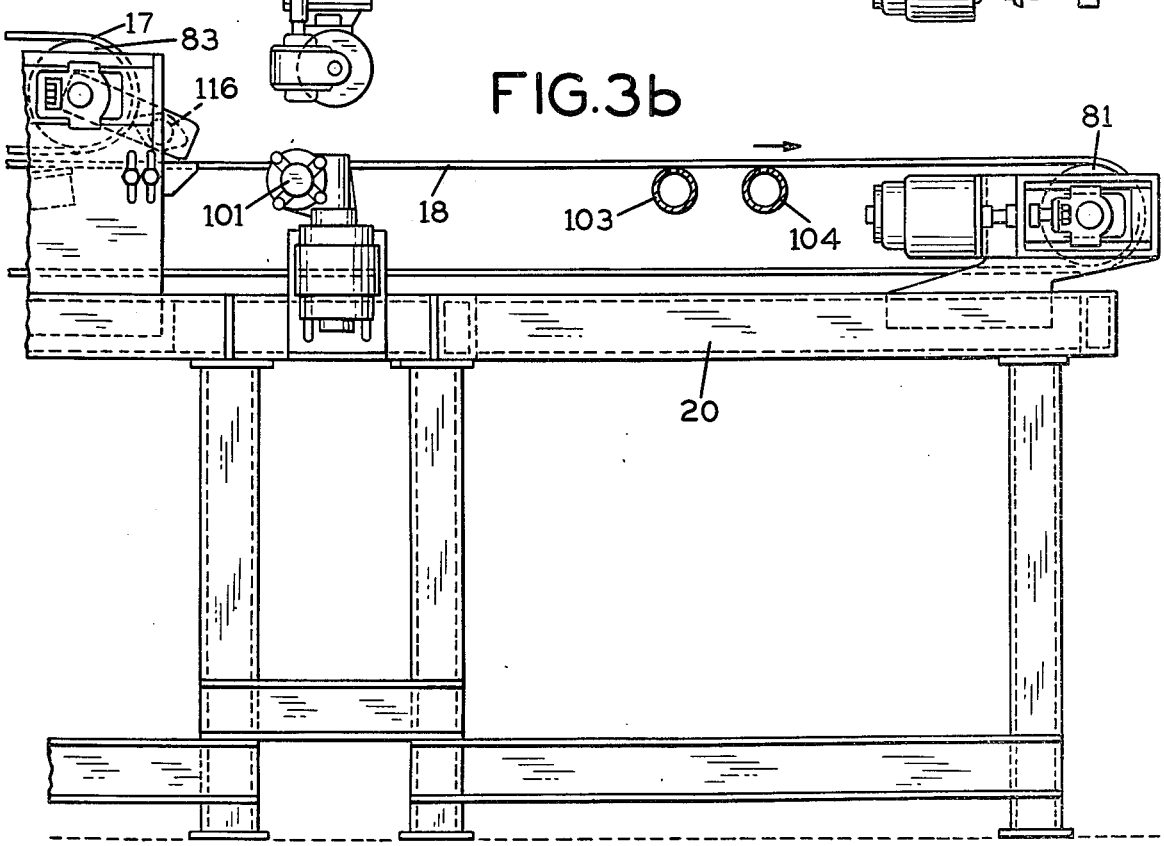

Referring now to the drawings, and initially to FIGS. 1 and 2 thereof, the apparatus of the invention is shown to include three primary sections, an entry section 10, a processing section 11, and a discharge section 12. In the entry section 10, individual, disconnected segments 13 of tubular knitted fabric are applied, cuff first, over the upstream end of a spreader-propeller mechanism 14. The initial application of the segment is done manually, after which the segment is processed exclusively by machine functions until it reaches the discharge end 12, where it typically is removed manually and suitably stacked in preparation for further operations.

While on the spreader, the segment 13, including both its cuff and body portions 15, 16, is distended laterally to a predetermined width. By means to be described, the segment is then, while still on the spreader frame 14, distended lengthwise and discharged between upper and lower conveyor blankets 17, 18, respectively. While the distended segment is gripped between the opposed conveyor blankets, it is exposed to steam from steam boxes 19. Thereafter, the steamed segments are released by the upper conveyor blanket 17, vertically agitated, amd discharged at the downstream end of the lower conveyor blanket 18.

Referring now more particularly to FIGS. 3–9, the equipment includes a pair of heavy frame members 20 supported by legs 21 and extending from one end to the other of the equipment to support its various component elements. Adjacent the front end of the frame members 20, there is mounted an edge drive mechanism, generally designated by the numeral 22. The mechanism includes a pair of side plates 23 mounting a pair of spaced guide bars 24 and journaling a threaded shaft 25 and splined drive shaft 26. A pair of edge drive carriages 27, 28 are slideably mounted on the guide bars 24 and one of them (28) is engaged with the threaded shaft 25. Rotation of the threaded shaft causes the carriage 28 to move toward or away from the carriage 27, which is normally fixed (but capable of adjustment). The carriages mount grooved edge drive rolls 29, which are arranged to be controllably rotated by the shaft 26 in any adjusted position of the carriages 27, 28.

The grooved edge drive rolls 29 engage and both position and support the spreader-propeller frame 14. In its broadest aspects, the spreader frame 14 is of a known type, although certain significant modifications are incorporated therein. The spreader includes a pair of elongated frame members 30, 31 which are connected to each other in the center area by means of an adjustable spacer rod 32. Each frame has a pair of grooved, contoured rollers 33, 34 which project slightly beyond the outer periphery of the frame members 30, 31 to engage and partly straddle the edge drive rolls 29. The rollers 33, 34 are convexly contoured to mate with the grooved edge drive rolls such that, when the spreader frame is positioned between the edge drive rolls and the latter are adjusted into light contacting relation with the rollers 33, 34, as shown in FIG. 4*a*, the spreader frame is held against vertical, lateral or longitudinal motion.

At the upstream end of the spreader frame there are provided entry belts 35, which are driven by the spreader frame rollers 33 and are trained appropriately about other rollers on the spreader frame so as to engage the opposite side edge extremities of a tubular fabric segment applied to the spreader frame. Discharge belts 36 are provided at the downstream end of the spreader frame, and these are driven by the spreader frame rollers 34. The sets of spreader frame rollers 33, 34 are driven at a constant peripheral speed by the edge drive rolls 29. However, by appropriately predetermining the depth of the grooves in which the respective entry and discharge end belts 35, 36 are seated in the rollers 33, 34, the entry belts 35 are caused to run at a slightly greater lineal speed than the discharge belts 36 to achieve a slight overfeeding of the fabric into the transition zone adjacent the edge drive rolls. In the apparatus of the invention, the fabric is conveyed through the transition zone by means of transition belts 37, which are trained about the spreader frame rollers 33, 34, advantageously in pairs, one above and one below the primary belts 35, 36.

Figure 4B:
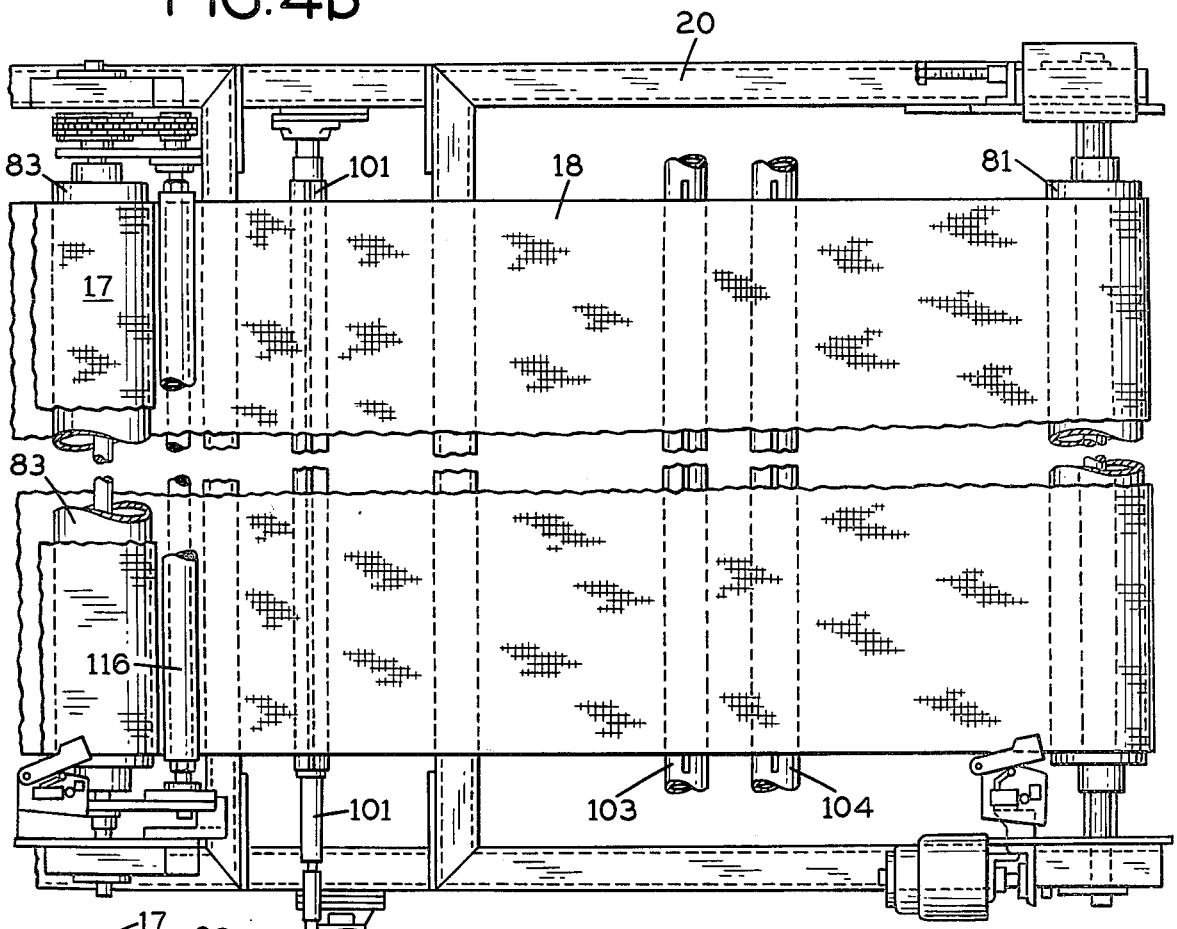
FIGS. 4*a* and 4*b*, taken together, comprise an enlarged top plan view of the apparatus of FIG. 1, with parts broken away to show many details of construction.
Figure 4A:
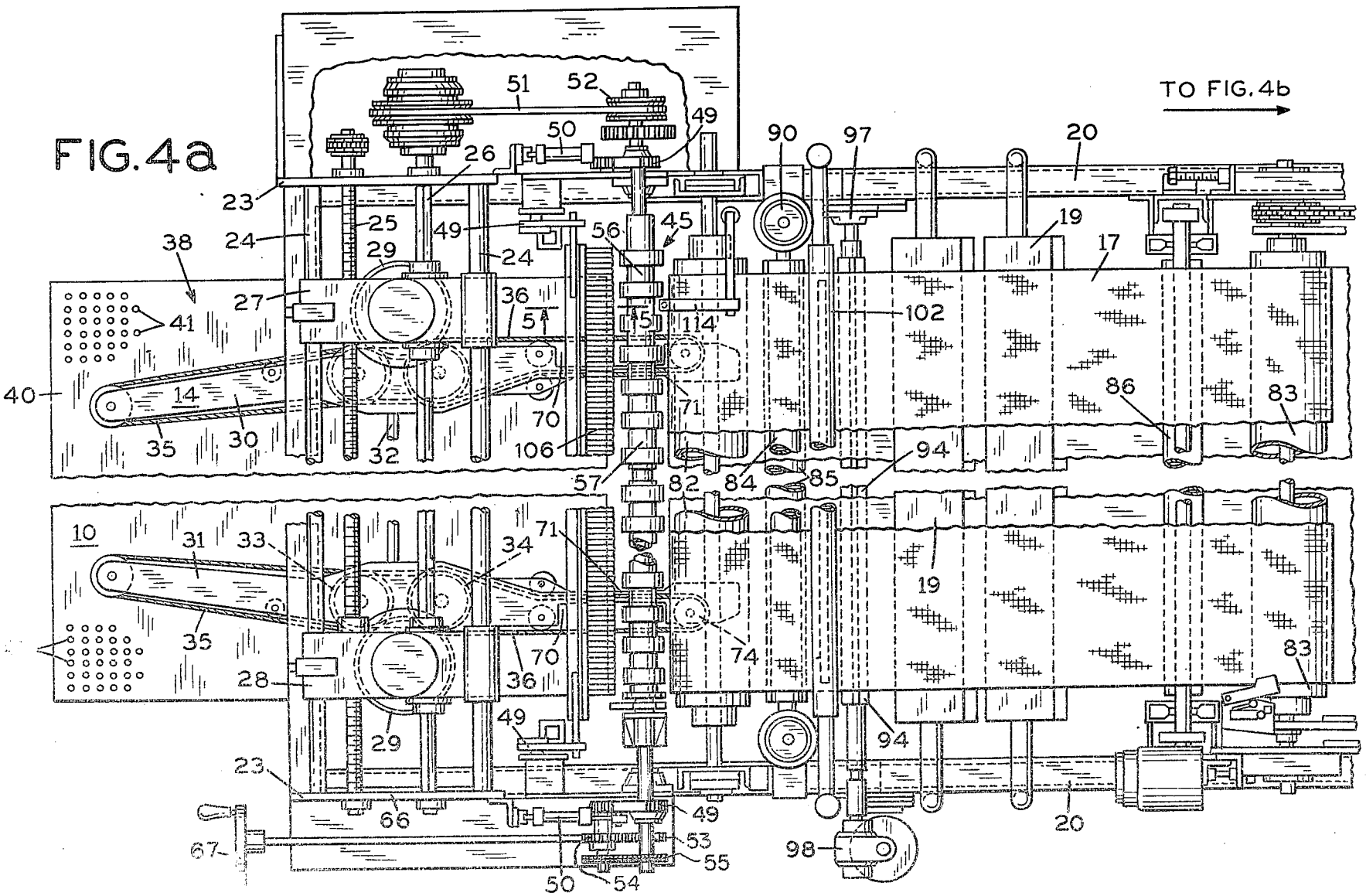
Figure 6:
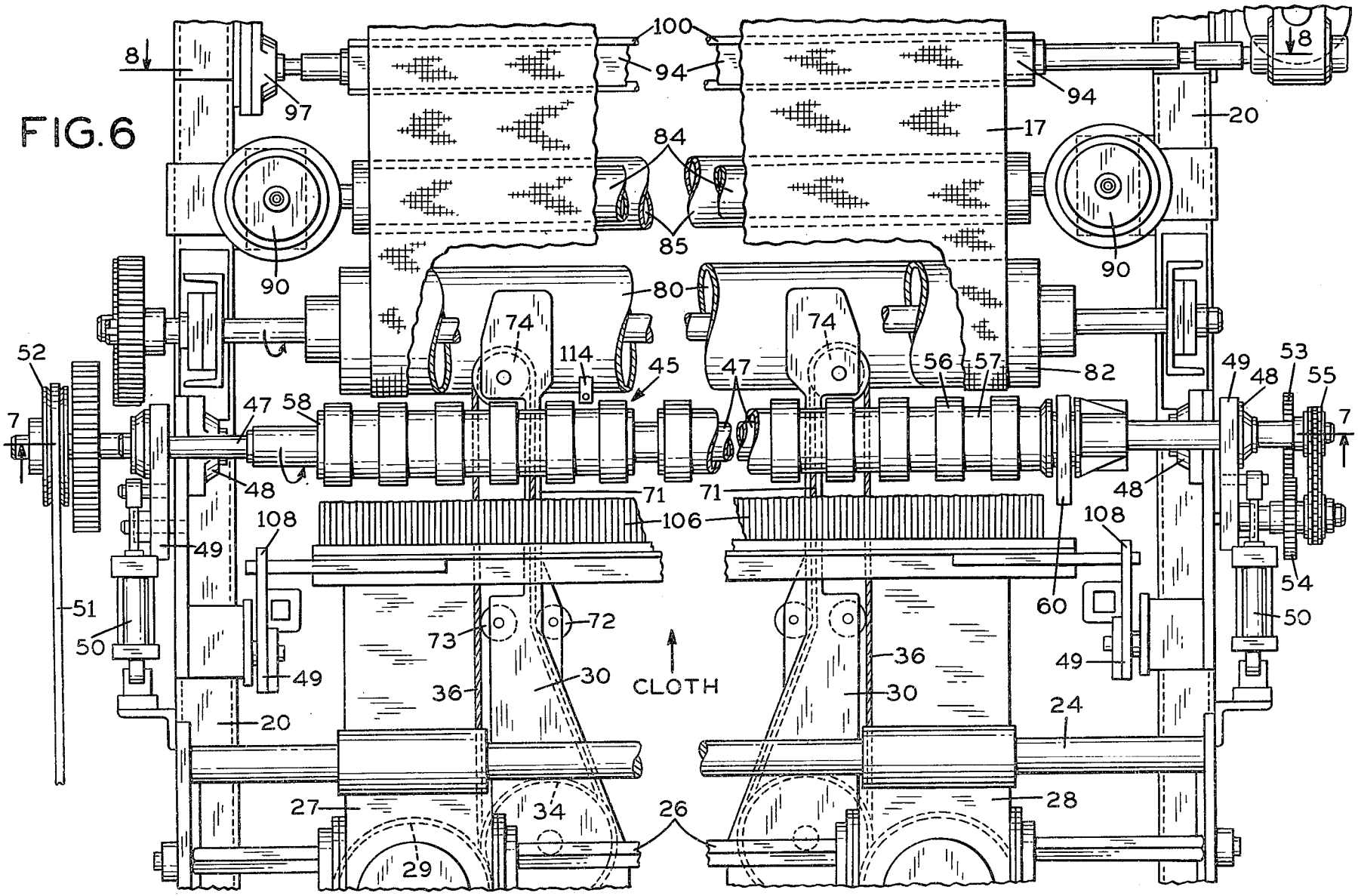
FIG. 6 is an enlarged, fragmentary top plan view of a portion of the apparatus of FIG. 1, showing details of the construction and operation of telescopically adjustable gripping rollers.
Figure 7:
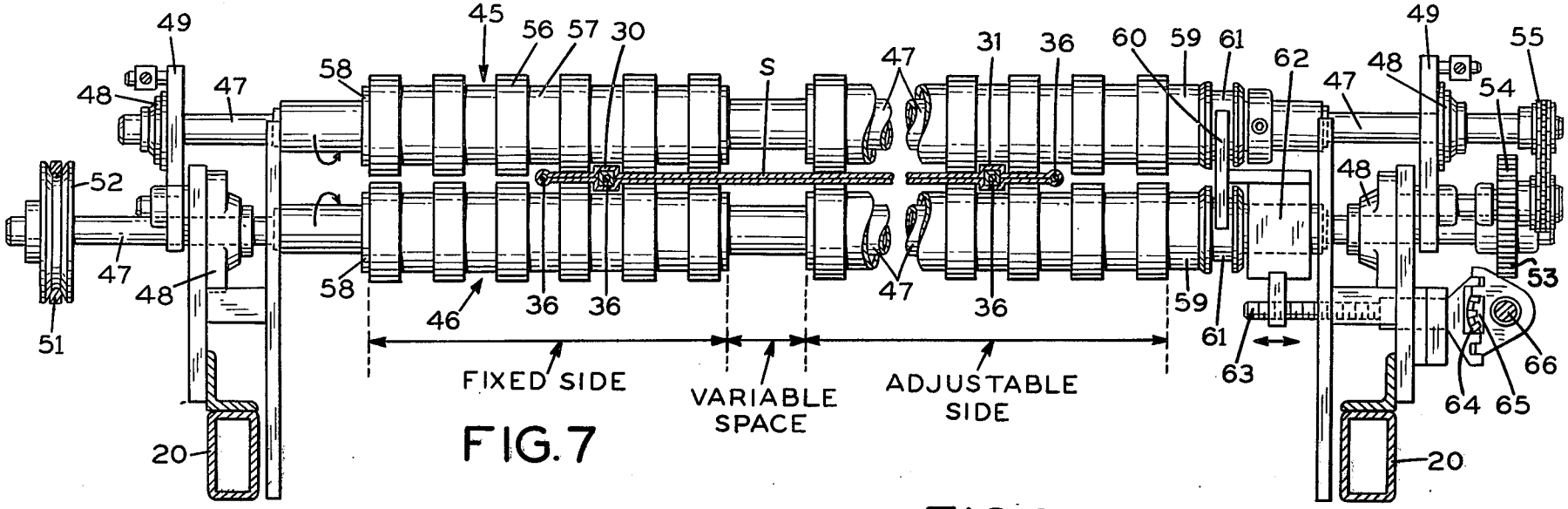
FIGS. 7 and 8 are cross sectional views as taken generally on lines 7—7, 8—8 respectively of FIG. 6.

As illustrated particularly in FIG. 4*a*, the entry end of the spreader frame expands in width up to the transition zone, adjacent the edge drive rolls and then remains substantially constant in width along the discharge or downstream end. The width of the frame is established to suit the requirements of the fabric being treated, and is adjusted by means of a facility (not shown) for lengthening or shortening the spacer rod 32.

In many instances, it is desirable or advantageous to process fabric segments in substantial widths, in order to achieve greater efficiencies in machine utilization. Thus, in the processing of sweater blanks, for example, it may be desirable to connect two or more open width blanks along their respective side edges, so that the width of a given fabric segment is a multiple of the width of a sweater body, for example. When processing segments of such increased width, the unsupported spans of fabric between the spreader side frames 30, 31 may tend to sag downwardly. To avoid drawing such sagging portions of the fabric across elements of the machine mechanism, and perhaps thereby causing center portions of the segment to lag, with resulting cross-line distortion, the edge drive rolls 29 are supported below their respective carriages 27,28, so that the carriage supporting, guiding and driving mechanisms are all located above the fabric. In addition, an air table 38 is positioned to extend under most of the spreader frame 14 to provide a measure of upward support for the fabric segment. The air table 38 includes a box-like chamber 39 extending from the entry-end extremity of the spreader frame 14 to a point near the discharge end. The upper surface 40 of the air table is relatively flat and is provided over its entire working area with a series of relatively closely spaced apertures 41. A suitable blower 42, draws air into the chamber 39 to be discharged over the working area of the upper surface 40, through the apertures 41. This tends to lift the fabric off of the surface of the air table and provides a substantially frictionless air cushion to facilitate conveyance of the segment without imposing drag on the center areas.

In accordance with an important aspect of the invention, provision is made for effectively drivingly gripping the tubular fabric segment across its full width, while the segment remains on the spreader frame 14, in order that longitudinal tension may be imparted to the laterally distended fabric, in a manner to be described. To this end, the apparatus of the invention is provided with a pair of opposed, banded gripping rolls 45, 46 (see particularly FIGS. 6 and 7). Each of the gripping rolls includes a supporting shaft 47, which may be in hollow tubular form in its center section for reduced weight. The lower supporting shaft 47 is supported by bearings 48 on the machine frame. The upper gripping roll 45 is supported by means of pivot arms 49, which enable the upper roll to be pivoted upward and out of the way by means of fluid actuators 50. The gripping rolls are driven at controlled, variable speed, by a belt 51 and pulley 52, which is connected directly to the lower roll 46. The upper roll 45 is driven directly from the lower roll, by a combination of gears 53, 54 and chain 55.

As reflected in the drawings, the banded gripping rolls are comprised of a series of annular banded portions 56 and adjacent recess portions 57 of equal widths. In general, the widths of the respective bands and recesses should be relatively narrow, approximately 2.5 centimeters having been found to be satisfactory. The banded areas of the respective gripping rolls are arranged to be in opposed relation to provide spaced gripping areas across the length of the rolls.

Pursuant to the invention, each of the gripping rolls is comprised of fixed and movable sections 58, 59. The fixed section 58 may comprise an overall length of, say, 25 centimeters, while the movable section may comprise the balance of the length of the roll. In a machine of 150 centimeters capacity, for example, the movable section might comprise about 120 centimeters, with the balance of five centimeters or so comprising a variable space between the fixed and movable sections.

The adjustable sides of the gripping rollers are manipulated by a bracket 60 which engages grooved collars 61 on the upper and lower rolls. The bracket 60 is carried by a slide block 62 engaged by a threaded shaft 63. The shaft 63 is rotated by a mechanism including bevel gears 64, 65, shaft 66 and hand wheel 67, enabling the movable sections 59 of the gripping rollers to be adjusted simultaneously toward or away from the fixed sections, within a limited distance. The total adjustment excursion need not be greater than the center to center distance between adjacent banded areas 56.

As shown particularly in FIG. 4*a*, the spreader frames 30, 31 are specially constructed adjacent their respective discharge end extremities as to be able to pass through adjacent opposed recess areas 57 of the gripping rolls. Thus, each of the frames is provided near its discharge end with a window-like recess 70, defined by a narrowed-down extension 71 of the spreader frame. The initial positioning of the normally fixed edge roll carriage 27 and its associated spreader frame 30 is such that the narrow frame extension 71 thereof is aligned with and extends through the space defined by a pair of opposed recesses 57 in the fixed portions of the gripping rolls (see FIG. 7). In addition, the arrangement of belt guide rollers on the spreader frame is such that one pass of the belt 36 is substantially within the frame extension 71 while the other pass of the belt extends through an opening formed by adjacent recesses in the gripping rolls.

Once the initial adjustments for the carriage 27 and a given spreader frame 30 are made, they normally are not changed, although some additional adjustment might be required to accommodate a spreader frame of slightly different configuration. Likewise, incremental adjustment of the normally fixed carriage 27 might be desired when setting up the machine to accommodate especially wide or especially narrow fabric. In any case, the normally fixed mechanisms would be adjusted in an incremental manner so that the extension 71 of the spreader frame passes through an opening formed by opposed gripping roll recesses.

At the opposite side of the machine, the other spreader frame 31 and its associated edge drive carriage 28 may be adjusted to any appropriate position suitable to the particular fabric being processed. Since, in any given adjusted position of the spreader frame 31, its frame extension 71 may not necessarily line up with an opening through the opposed gripping rolls, the adjustable portions 59 of those rolls may be telescopically manipulated toward or away from the fixed portions, by means of the hand wheel 67, to achieve proper alignment. As will be appreciated, any amount of lateral adjustment of the spreader frame, within the capacity of the machine, may be accommodated by a range of adjustment of one full unit of distance along the gripping roll, comprising a band and a recess. Thus, when the equipment is properly set up and adjusted for tubular segments of a given width, the segment passing over the discharge end of the spreader 14 is grippingly engaged effectively across its full width by the spaced, banded areas of the opposed gripping rolls. In this respect, although the actual gripping is discontinuous between adjacent banded areas, the spaces between adjacent bands are sufficiently narrow that there is little opportunity for the fabric to distort in these intervening spaces, at least in normal operations of the equipment.

As reflected in the drawings, the lower conveyor blanket 18 is trained about a pair of elongated, relatively large diameter rollers 80, 81 rotably supported on the machine frame. The upper conveyor blanket 17 is similarly supported on elongated, relatively large diameter rollers 82, 83. The rollers 80, 82 are located substantially in vertical alignment, whereas the roller 83 is located well upstream of the roller 81. The upper conveyor blanket 17 is thus considerably shorter than the lower conveyor blanket, providing for a runout of the lower blanket of substantial length.

As reflected in FIG. 2, the upper belt supporting rolls 82, 83 are positioned considerably above the plane of the lower conveyor blanket 18. The arrangement is such that the confronting passes of the two conveyor blankets normally would be separated by a space of several centimeters, sufficient to receive between them the discharge end of the spreader frame 14. A short distance downstream from the discharge end of the spreader frame, there is provided a pair of opposed nip rollers 84, 85, arranged to bring the conveyor blankets together in confronting relation. A second pair of nip rollers 86, 87 is located near the downstream end of the upper conveyor blanket; these likewise serve to guide the respective conveyor blankets in confronting relation. Thus, as will be evident in FIG. 2, the spaced pairs of nip rollers 84, 85 and 86, 87 define an elongated processing region in which the two conveyor blankets are guided in contacting or substantially contacting relationship.

Significantly to the present invention, the upstream pair of nip rollers is adapted to be controllably opened and closed. To this end, the lower nip roller 85 may be mounted on a fixed axis, by bearings 88, while the upper nip roller 84 is mounted in movable bearings 89 carried by fluid actuators 90 at each side of the machine frame. When the actuators 90 are energized to lower the upper nip roller 84, the roller is moved downwardly to divert the upper conveyor blanket down toward the lower blanket. Downward movement of the actuators 90 may be controlled by regulating the fluid pressure applied thereto, or suitable stop means (not shown) may be provided, or possibly a combination of both.

The downstream nip rollers 86, 87 also may be arranged so that the lower roller 87 is supported on a fixed axis, while the upper roller 86 is vertically movable, being normally drawn downwardly against fixed stops by means of fluid actuators 91 at opposite sides of the machine frame.

As will be made evident hereinafter, the upstream nip rollers are regularly opened and closed as part of the normal process of sequence, by appropriate energizing of the actuators 90. The downstream nip rollers, on the other hand, are normally maintained in their closed relationship during processing.

Between the sets of nip rollers, the conveyor blankets are held in closely confronting relationship over a substantial length. In this region, opposed sets of steam boxes 92, 93 are provided, which direct jets of steam at and through the conveyor blankets 17, 18. The conveyor blankets are constructed of a permeable material, such as woven nylon mesh, so that the steam can pass through the blanket material and penetrate a fabric segment being conveyed through the steaming zone by the opposed blankets. The steam boxes 92, 93 may be of a general type shown in the Cohn et al. U.S. Pat. No. 2,602,314 and, desirably, the opposed sets of steam boxes are offset slightly one with respect to the other so that steam jets issued by one box do not directly oppose jets issued by the opposing steam box.

Mounted below the lower conveyor blanket 18, between the first nip rollers 84, 85 and the steam boxes, is a first agitator roll 94, which lies directly under the lower conveyor blanket and is arranged, when rotated, to periodically displace the blanket sharply upward on a rapidly repetitive basis. The conveyor blanket, being under considerable lengthwise tension, tends quickly to return to its normal plane. However, the fabric segment which is being conveyed by the blanket, and is unrestrained, will tend to be lifted off of the blanket by the rapid vertical displacement. This facilitates relaxation and geometric adjustment of the fabric, as will be understood. In this respect, when the upstream nip rollers 84, 85 are in their closed relation, any fabric segment passing over the agitator roller 94 will be effectively constrained by the upper blanket 17, such that the roller 94 will have little or no effect. However, when the upper nip roller 84 is raised, allowing the upper blanket 17 to retract upwardly in the entry area, a fabric segment passing over the agitator roller will be at least partially unrestrained and free to react to the repetitive displacement.

In the system of the invention, it is contemplated that the front nip rollers 84, 85 will open momentarily while the cuff portion of a segment passes over the first agitator roller. This encourages relaxation of the cuff after its discharge from the spreader 14.

Figure 8:
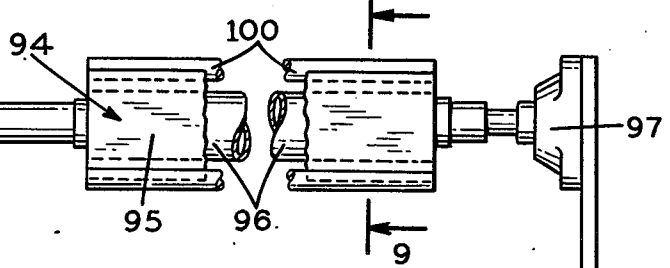
Figure 9:
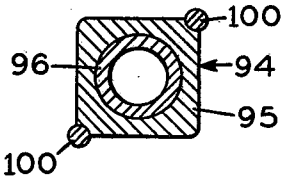
FIG. 9 is a fragmentary cross sectional view as taken on line 9—9 of FIG. 8.

As reflected in FIGS. 8 and 9, the agitator roller 94 may advantageously be in the form of a square bar 95, which is supported for rotation on a shaft 96. At one side of the machine, the shaft 96 is supported by a bearing 97. At the other side of the machine, the shaft is both supported and driven by a gear box 98 and motor 99 mounted on the machine frame. Small rods or bars 100 are welded to diagonally opposite corners of the square bar 94 along its full length, to accentuate the eccentricity of the displacement roller.

As reflected in FIGS. 2, **3*b* and 4*b*, a second agitator roll assembly 101, of a construction similar to that just described, is positioned directly under the roller conveyor blanket 18 at a point slightly downstream of the discharge end of the upper conveyor blanket 17**. The arrangement is such that, when a treated fabric segment emerges from between the conveyor blankets and is being carried on the lower blanket alone, it is again exposed to a rapidly repetitive, relatively high amplitude vertical agitation, to permit the fabric to further relax and adjust.

In the processing of sweater segments and the like, where differential contraction of different portions of the segment is an objective, it is important to prevent the segment from being or becoming excessively moist while it is on the spreader 14. To this end, both of the conveyor blankets 17, 18 are dried by removal of residual surface moisture before coming into contact with the fabric in the region of the discharge end of the spreader. For the upper blanket 17, this is best accomplished by a vacuum head 102, which is in contact with the upper pass of the blanket, across its full width, at a location between the spreader and the steam boxes 19. Thus, any moisture remaining on the blanket 17, whether derived from the passage of the blanket through the steaming zone or by contact with excess steam in passing over the top of the steam boxes, can be removed, and the upper blanket approaching the spreader frame is as dry as practicable. The blanket material is, of course, of a hydrophobic nature, so that any moisture present in the conveyor blanket is on the surface of the fibers.

The lower conveyor blanket 18 advantageously is dried by means of full width vacuum heads 103, 104 located along the runout portion of the lower blanket. At this location, the vacuum heads can accomplish two functions, one being to extract excess moisture from the processed fabric segments, and another to remove moisture from the blanket itself.

In addition to removing moisture from the conveyor blankets 17, 18, provision is made for preventing random flow of excess steam from the area of the steam boxes 19 toward the forward regions of the machine, where it could come into contact with the fabric on the spreader. In this respect a typical installation of equipment will be provided with a suitable steam hood (not shown) over the top of the steamer area, associated with a suitable exhaust fan and duct system. In addition to that, the forward end of the air table 38 is provided with a nozzle 105 (see FIG. 2) which extends across the width of the machine and is directed slightly upwardly and in a downstream direction. This provides for a general flow of air in a downstream direction, toward and into the entry area of the conveyor blankets. The thus-directed flow of air serves as a buffer to prevent random migration of steam in an upstream direction, and assures that the fabric segment, and particularly the cuff area, is kept free of contact with steam until it has been discharged from the spreader and has had an opportunity to adjust and contract to its normal dimension.

When a discreet segment of knitted fabric is laterally distended by the spreader 14, the free end edge of the segment (opposite to the cuff) will have a tendency to curl over upon itself. In order to prevent the curl from being carried through into the conveyor blanket section, a decurling arrangement is provided, which includes a pair of transversely extending brushes 106, 107 (FIG. 5) carried by brackets 108, 109 pivoted on the machine frame at 110, 111. The brushes 106, 107 are mounted respectively above and below the plane of the segment S and extend in a generally downstream direction, at a relatively shallow angle to the plane of the fabric. The supporting arms 108, 109 for the brushes are connected together by gear segments 112 for pivoting movement toward or away from the processing plane in unison. The lower support 109 is connected to actuating cylinders 113 at each side which, when extended, move the brushes toward the processing plane and, when retracted, swing the brushes away from the plane. Suitable adjustable stop means (not shown) may be provided to limit the extending movement of the cylinder 113 so that the brushes 106, 107 contact the fabric segment S with the desired amount of pressure.

Actuation of the decurling brushes 106, 107 is under the control of a photocell device 114, which is arranged to "look" into the gap between the banded gripping rollers 45, 46 and the blanket supporting rollers 80, 82. When a light beam reaches the photocell detector, indicating the absence of a sweater segment in the discharge end of the sweater, the brush actuating cylinder 113 is retracted. Also, the actuators 90 for the upper nip roll 84 are caused to retract, to open the first roller nip in preparation for the entry of a fabric segment.

As a new segment approaches the end of the spreader, travelling cuff first, the cuff portion is permitted to travel freely through the decurling area, located just upstream of the banded gripping rollers, because the brushes will at this time be in open positions. As soon as the advancing cuff interrupts the light beam, a control is initiated which energizes the brush actuating cylinder 113 to close the brushes upon the fabric segment. As reflected in FIG. 5, when the curled edge 115 of the segment reaches the brush tips, which are now closed upon the fabric, the brushes will roll back the curl and bring the fabric into a flat condition for further processing.

Interruption of the photocell system 114 by the advance of the cuff also activates an adjustable timing circuit (not shown) which controls operation of the nip roll actuators 90, for controlling closure of the first nip. The timer introduces a predetermined, adjustable delay period between interruption of the light beam and closure of the first nip. This period is sufficient to enable the cuff portion of the segment to be discharged from the spreader and receive a brief agitation from the first agitator roll 94, enabling the cuff to relax and geometrically readjust to a reduced width. The first nip is thereupon closed, gripping the segment somewhere in the region in which the cuff joins to the body portion.

Figure 14:
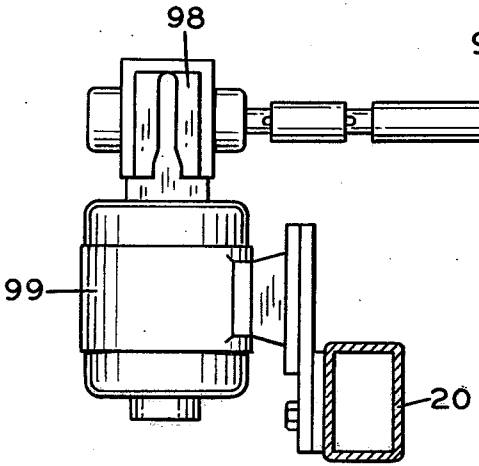
FIG. 14 is a schematic view of a drive system utilized in the apparatus of the invention.
Figure 14:
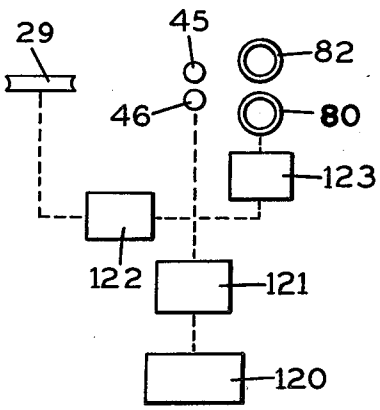

The various drive systems for the apparatus illustrated are, in themselves, not a significant aspect of the invention. Provisions are made, however, for adjusting the speed of the equipment as a whole, and also certain stages of the equipment relative to others. For convenience, the primary drive motor 120 (FIG. 14) of the equipment operates through an appropriate variable speed control 121 to drive the banded gripping rolls 45, 46. This speed may be varied to accommodate the desired production rates, process variables, etc. and determines the basic machine speed. The edge drive rolls 29, and hence the spreader belts 35–37, are driven off the main drive and primary speed control 120, 121, through a secondary speed control 122, so as to be variable in relation to the speed of the banded gripping rolls. In this respect, the propeller belts typically will be operated at a speed which is either equal to or perhaps slightly greater than the speed of the banded gripping rolls, so that the incoming fabric segment is either free of longitudinal tension or perhaps even slightly overfed as it approaches the gripping rolls.

Figure 11:
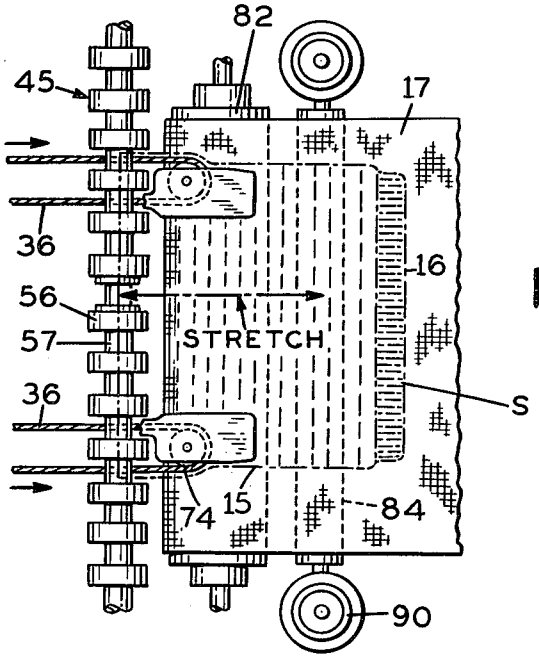
FIGS. 10 and 11, are schematic sequential illustrations showing the manner in which a tubular segment is distended laterally and longitudinally in accordance with the invention.
Figure 13:
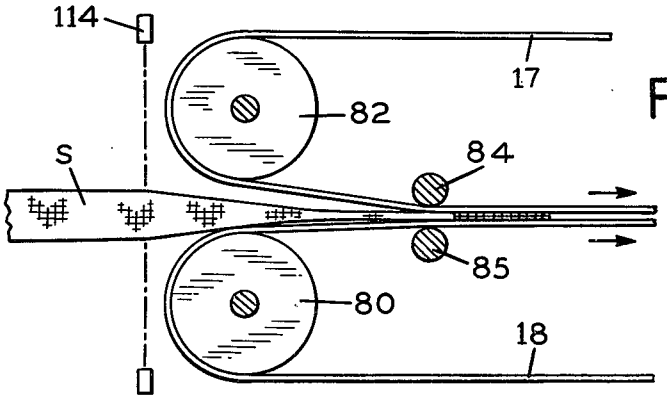
FIGS. 12 and 13, are schematic sequential views illustrating the manner in which differential relaxation of cuff and body portions is achieved in accordance with the invention.
Figure 10:
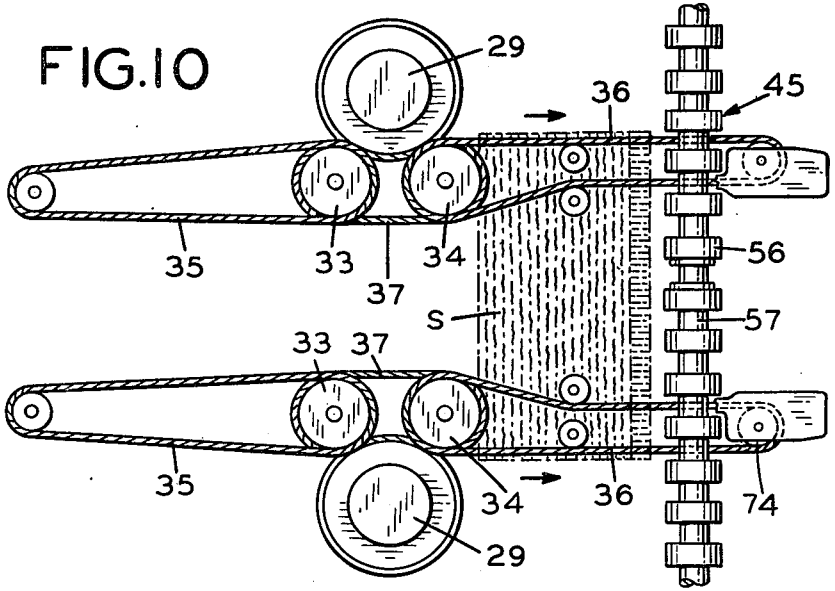
Figure 12:
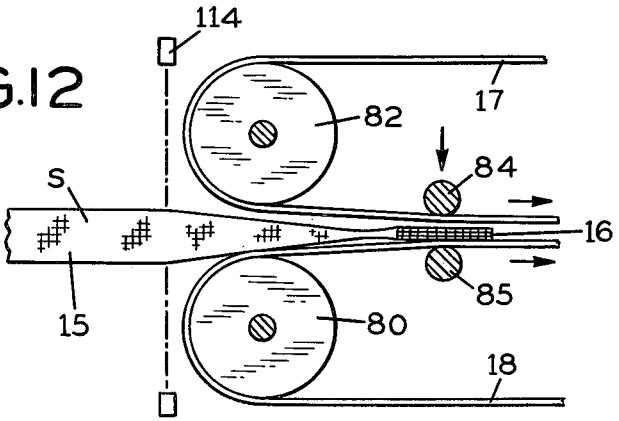

The conveyor blankets 17, 18 are likewise driven off of the main drive and speed control 120, 121, through an independent secondary speed control 123, in such manner as to be variable in speed relative to the banded gripping rolls. In a typical processing sequence, for the processing of sweater segments, the speed of the conveyor blankets may be set to be as much as 50% greater than the peripheral speed of the banded gripping rolls. This imparts a substantial degree of lengthwise stretch to the segment, in the region between the banded rolls 45, 46 and the first nip 84, 85 (see FIG. 11). The arrangement is such that the processed segment may have a length up to 10 to 15% greater than that of the incoming fabric.

SUMMARY OF OPERATION

For the processing of sweater blanks, for example, disconnected segments are applied cuff first to the upstream end of the spreader 14. The segment is advanced by the upstream belts 35 while being laterally distended to the desired processing width. Fabric then passes on to the transition belts 37, passing around the edge drive rolls 29, and then is picked up by the downstream spreader belts 36. Usually, the speed of the incoming or upstream belts is greater by a few percent than the speed of the downstream belts, so that the fabric is slightly overfed onto the latter. This tends to compensate for a tendency of the fabric segment otherwise to assume a bowed condition in the crosslines, resulting from the lateral distension of the fabric and a consequent tendency for the fabric to shorten except where restrained at the edges.

The cuff section of the segment passes through the opened decurling brushes 106, 107 and, while still on the spreader, is engaged by the banded gripping rollers 45, 46. The effective or peripheral speed of the gripping rollers may be equal to or slightly less than that of the spreader belts.

As the leading or cuff edge of the segment passes beyond the gripping rollers 45, 46 it interrupts a light beam, activating the photocell 114. This causes the decurling brushes to close upon the fabric segment, immediately upstream of the gripping rolls, and also commences an adjustable timing period, through timer control 119, for controlling the closing of the first nip rolls 84, 85.

As the cuff section of the fabric segment is discharged from the spreader onto the lower conveyor blanket 18, and while the first nip rolls 84, 85 remain open, the cuff area is effectively agitated by the first agitator roll 94, to encourage relaxation and adjustment of the cuff to its normal width. At the end of a predetermined time period, the nip rollers close, bringing the conveyor blankets 17, 18 together, so that the fabric segment is effectively clamped between the conveyor blankets. The vibrator roll 94, while still in motion, is of limited effectiveness at this time, inasmuch as the fabric is already gripped by the blankets and has little or no opportunity to readjust. Desirably, in this respect, the vibrator roll 94 is positioned closely adjacent to the first nip 84, 85, preferrably on the downstream side thereof.

Considerable control over the cuff and adjacent areas of the sweater blank can be affected by varying the timing of closure of the first nip rolls 84, 85. By closing the nip rollers rapidly, the cuff area may be exposed to very limited effective action by the agitator roll 94 and thus may have limited opportunity to adjust and contract. On the other hand, by extending the delay period such that the nip rollers first close upon the segment at a point entirely beyond the cuff section, additional contraction of the cuff may be induced, and a tapered effect may be achieved in the portion of the sweater blank adjacent to the cuff.

As a significant process variable, the surface speed of the conveyor blankets 17, 18 may be variably controlled with respect to the peripheral speed of the banded gripping rollers 45, 46, in order that the fabric segment may be placed under significant lengthwise tension while it remains on the spreader frame. In this respect, the construction of knitted fabrics is such that lateral distension tends to be accompanied by lengthwise shortening, and longitudinal tension tends to be accompanied by narrowing in the width. For many sweater fabrics, not only is shortening in the length undesirable during framing and steaming, but it is desired to actually increase the length of the finished segment while at the same time increasing its width. The unique construction of the present apparatus makes this possible, by enabling the fabric to be gripped across its full effective width by the banded gripping rollers 45, 46, while the fabric is well upstream of the discharge end of the spreader frame. When the nip rollers 84, 85 are closed, the fabric is gripped by the conveyor blanket almost immediately as it leaves the spreader frame. By adjusting the conveyor blankets to operate at a higher speed than the gripping rollers, the fabric is caused to be put under lengthwise tension while still on the spreader frame, to increase its length without causing or permitting a narrowing in width. Since the fabric is almost immediately gripped over its entire surface as it is discharged from the spreader frame, the fabric does not have an opportunity to contract to its initial dimensions, although a limited amount of controlled contraction is to be expected.

Once the fabric is effectively gripped by the conveyor blankets 17, 18, it is conveyed between the sets of steam boxes 19 and thoroughly steamed. This lubricates the fibers and enables the fabric segment to become stabilized in the geometric condition in which it is held by the blankets.

As the fabric segments emerge on the downstream side of the second nip rollers 86, 87, the upper conveyor blanket 17 is guided upwardly and then back toward the front of the machine, while the lower blanket continues in the downstream direction carrying the processed segments. In some cases, the segments may tend to adhere to the upper conveyor blanket, in which case they are removed by a counter-rotating brush roll 116. A second agitating roller 101 is located under the conveyor blanket 18, slightly beyond the end of the upper conveyor blanket 17, in order to impart vertical agitation to the sweater segments as they are released from the grip of the opposed blankets. This agitating action, having sufficient vertical amplitude to repetitively lift the sweater segments off of the conveyor blanket 18, permits a further relaxation and stabilized readjustment of the sweater segment.

After being released and agitated, the segments are passed over the vacuum heads 103, 104 to remove excess moisture from the segment, and also dry the conveyor blanket in preparation for its return to the front of the machine. Finished segments are taken from the discharge end of the machine by suitable automatic or manual means.

The method and apparatus of the invention have enormous versatility in connection with the processing of disconnected segments of knitted fabric, such as sweater bodies, sleeves, etc. because of the significant process variables that can be precisely controlled. Thus, the initial width distension of the segment may be controlled by lateral adjustment of the spreader frame 14. Overfeed between the upstream and downstream sections of the spreader frame, while normally not adjustable in the usual sense, May be varied in an incremental way by utilizing different sets of drive rollers 33 for the upstream spreader belts and, while the effective speed of the spreader-propeller 14 at the discharge end normally will closely correlate with the speed of the banded gripping rollers 45, 46, variability in the speed of the spreader-propeller, in relation to the banded gripping rollers, for fine adjustment purposes, is provided by variable speed control of the edge drive rolls 29, in relation to the machine speed.

More important process variables are introduced by controlling the speed of the conveyor blankets 17, 18 in relation to the speed of the banded gripping rollers, in order to control tension applied to the fabric segment, while it remains on the discharge end of the spreader frame. This enables controllable lengthening of the segment without corresponding reduction in its width. Additionally, controlled variation in the timing of closing of the first nip rollers 84, 85, in relation to the passage of the leading or cuff end of the segment, enables an important control to be exercised over the condition of the cuff area and portions of the segment immediately adjacent thereto. Thus, variation in the time of closing of the first nip rollers affects not only the moments at which lengthwise tension is applied to the segment, but also controls the duration of effectiveness of the first agitator roll 94. Of lesser significance, perhaps, pressure adjustment and/or adjustable fixed stops may be provided in connection with the movable nip roller 84, to control the conditions of its closing. Also, as set forth in the beforementioned Bryan patents, the position of the nip, may be made to be adjustable in upstream or downstream directions, in relation to the discharge end of the spreader frame, providing additional control over the interval between discharge of the fabric from the spreader and its effectively gripped engagement by the conveyor blankets.

The apparatus of the invention may also be utilized for the processing of continuous tubular yard goods. In such cases, since application of longitudinal tension is usually neither necessary nor desirable, the banded gripping rolls 45, 46 may be left open. Likewise, the operation of the equipment may be so adjusted that fabric is slightly overfed from the spreader frame 14 into the entry end of the conveyor blankets 17, 18. Processing of continuous yard goods in this manner can be advantageous, particularly with respect to sensitive fabrics, because the fabric is not exposed to steam until it has been discharged from the spreader frame, and it is thus less likely to be marked during its passage over the spreader.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. Apparatus for the processing of tubular knitted fabrics, particularly in disconnected segments having integrally joined cuff and body portions, which comprises (a) spreader means for engaging a segment internally and distending it laterally to flat, two-layer form of predetermined width, (b) said spreader means comprising spaced frame members supporting fabric advancing belts, (c) a pair of gripping rollers arranged in straddling relation to said spreader means and arranged to have effective full width gripping relation with a fabric segment on said spreader means, (d) said spreader means having a discharge end downstream of said gripping rollers, (e) a pair of conveyor blankets positioned generally adjacent to the discharge end of said spreader means for receiving a fabric segment therefrom and operative to engage and grip the fabric on opposite sides, over its full width and for at least a substantial lengthwise extent, (f) controllable driving means for said gripping rollers and conveyor blankets, whereby said blankets may be driven at a speed greater than the gripping rollers to effect elongation of fabric on said spreader frame, and (g) means for steaming the fabric while gripped by said conveyor blankets.

2. Apparatus according to claim 1, further characterized by (a) said spreader means being adjustable to accommodate segments of different widths, (b) said gripping rollers being of banded configuration, having a series of opposed annular recesses, and (c) elements of said spreader means being receivable in said intervening recesses while said opposed annular bands are in substantially contacting relation.

3. Apparatus according to claim 2, further characterized by (a) the banded gripping rollers being of telescopic construction, each including a fixed portion and a telescopically adjustable portion, and (b) one of the frame members of said spreader means being received in opposed recesses of fixed portions of said gripping rollers and the other of the frame members being received in recesses of the telescopically adjustable portions of said rollers.

4. Apparatus according to claim 3, further characterized by (a) said gripping rollers having a large plurality of closely spaced annular bands and recesses, (b) said rollers having an adjustment range at least equal to the combined width of a band and a recess.

5. Apparatus according to claim 1, further characterized by (a) said spreader frames comprising upper and lower metal plates mounting belt guiding wheels, (b) said plates being substantially cut away in the region of said gripping rollers to form window-like openings to receive banded portions of said gripping rollers.

6. Apparatus according to claim 1, further characterized by (a) said spreader means including pairs of entry end belts, transition belts, and exit end belts, (b) edge drive rolls engaging and supporting the spreader means in the region of the transition belts, and driving the several pairs of belts, (c) said entry end belts being driven at a speed greater than the exit end belts to effect overfeed of the fabric segment onto the exit end belts, (d) a pair of belt drive wheels at each side, supported and driven by said edge drive rolls and drivingly engaging the respective entry end and exit end belts, (e) said transition belts extending between and being driven by said pairs of belt drive wheels.

7. Apparatus according to claim 1, further characterized by (a) said spreader means comprising fabric engaging belts at each side for engaging the fabric internally, (b) driven edge drive rollers engaging and supporting said spreader means and supported from above the spreader means, and (c) an air table positioned beneath said spreader means and providing a cushion of air beneath a segment of fabric on said spreader means.

8. Apparatus according to claim 1, further characterized by (a) said spreader means having a discharge end generally between said conveyor blankets, (b) controllable nip-forming means for guiding the conveyor blankets in the vicinity of said discharge end for effecting initial gripping engagement of a segment at controllable distances from said discharge end.

9. Apparatus according to claim 8, further characterized by (a) means for opening and closing said nip-forming means, (b) means for detecting the approach of an edge of the fabric segment, and (c) time delay means associated with said detecting means for controlling opening and closing of said nip-forming means.

10. Apparatus for processing tubular knitted fabrics, particularly disconnected segments thereof having integrally connected cuff and body portions, which comprises, (a) a spreader frame having driven belts for engaging the fabric internally and advancing it while spreading it to predetermined width, (b) a pair of conveyor blankets arranged in generally opposed relation for gripping and conveying fabric segments, (c) said spreader frame having a discharge end at the entry end of said conveyor blankets, (d) first controllable nip forming means for guiding said blankets into initial fabric gripping engagement a controllable distance downstream of said discharge end, (e) said first nip forming means comprising a pair of nip forming elements movable toward and away from each other between relatively more closed and relatively more open positions, (f) segment edge detecting means operative to sense the approach toward said first nip forming means of the end edges of a fabric segment, (g) control means responsive to said detecting means for maintaining said nip-forming means relatively more open for one edge (cuff) than the other, (h) second nip forming means located substantially downstream of said first nip-forming means, and (i) means for steaming the fabric in the region between said first and second nip forming means.

11. Apparatus according to claim 10, further characterized by (a) an irregularly shaped agitating roller contacting the lower one of said conveyor blankets in the region immediately adjacent said first nip-forming means and operative to agitate said lower conveyor blanket with a substantial vertical amplitude, (b) said agitating roller being effective to lift the fabric segment off of the lower conveyor blanket in the immediate vicinity of the agitator roll, when said nip forming means is in a relatively more open condition.

12. Apparatus according to claim 11, further characterized by (a) said segment is advanced cuff first by said spreader frame, (b) said detecting means comprises a photocell operative to execute a control function in response to the advance of the segment cuff, (c) time delay means operative in response to said control function to close said first nip-forming means at a predetermined, adjustably controllable time in relation to the passage of said cuff past said first nip-forming means.

13. Apparatus according to claim 12, further characterized by (a) said time delay means being operative to effect closing of said first nip-forming means only after passage therethrough of at least a substantial portion of said cuff.

14. Apparatus according to claim 10, further characterized by (a) gripping means engaging opposite surfaces if the fabric across its width at a point substantially upstream of the discharge end of said spreader frame, (b) separately variable drive means for said gripping means and said conveyor blankets, whereby a fabric segment on said spreader frame may be controllably elongated without corresponding loss of width.

15. Apparatus according to claim 14, further characterized by (a) said gripping means comprises a pair of opposed, banded rollers having a large plurality of opposing annular bands and recesses, (b) portions of said spreader frame being receivable in said recesses while said segment is effectively gripped across its full width by a plurality of opposed banded areas.

16. Apparatus according to claim 10, further characterized by (a) said spreader frame being supported from above, (b) air table means being positioned directly underneath said spreader frame and having a perforated upper surface for the issuance of a plurality of air streams to provide relatively frictionless support of the lower portions of said segment.

17. Apparatus according to claim 10, further characterized by (a) a pair of opposed de-curling members on opposite sides of the spreader frame, (b) actuating means for moving said de-curling members into and out of de-curling position, and (c) control means associated with said edge detecting means and operative temporarily to move said de-curling members out of de-curling position to accommodate free passage of the leading edge of a fabric segment.

* * * * *